US009961429B2

(12) United States Patent
Williams et al.

(10) Patent No.: US 9,961,429 B2
(45) Date of Patent: May 1, 2018

(54) WEARABLE ELECTRONIC DEVICE HAVING ORNAMENTAL AND DEPLOYMENT MODES

(71) Applicant: Tinsel Inc., San Francisco, CA (US)

(72) Inventors: Aniyia L. Williams, San Francisco, CA (US); Thi Phuong-Nam Bagley, San Francisco, CA (US)

(73) Assignee: Tinsel Inc., San Francisco, CA (US)

( * ) Notice: Subject to any disclaimer, the term of this patent is extended or adjusted under 35 U.S.C. 154(b) by 0 days. days.

(21) Appl. No.: 15/164,645

(22) Filed: May 25, 2016

(65) Prior Publication Data

US 2016/0353193 A1 Dec. 1, 2016

Related U.S. Application Data

(60) Provisional application No. 62/166,105, filed on May 25, 2015.

(51) Int. Cl.
*H04R 1/10* (2006.01)
*A44C 15/00* (2006.01)

(52) U.S. Cl.
CPC ..... *H04R 1/1033* (2013.01); *A44C 15/005* (2013.01); *A44C 15/0085* (2013.01); *H04R 1/1016* (2013.01); *H04R 2201/023* (2013.01); *H04R 2225/31* (2013.01); *H04R 2420/07* (2013.01); *H04R 2460/17* (2013.01)

(58) Field of Classification Search
CPC ..... H04R 1/10; H04R 1/105; H04R 1/1016; H04R 1/1033; H04R 1/1066; H04R 5/033; H04R 5/0335
See application file for complete search history.

(56) References Cited

U.S. PATENT DOCUMENTS 6,721,579 B2 * 4/2004 Liu ..... H04M 1/6058 379/373.02
2008/0161023 A1 7/2008 Ko
2011/0216931 A1 9/2011 Bui
2014/0338397 A1 * 11/2014 Andreini, III ..... A44C 15/005 63/1.14

* cited by examiner

*Primary Examiner* — Matthew Eason
(74) *Attorney, Agent, or Firm* — Louis Wu

(57) ABSTRACT

A wearable electronic, e.g., audio, device is provided having ornamental and deployment modes. A flexible loop of the device allows for at least partial conformal contact with a surface of an individual or the individual's clothing, or both. A first ornamental component is physically associated with the loop. At least one flexible cable segment extends from the loop or the ornamental article and terminates in an electronic component. An electronic interface is wired to each electronic component for electronic communication therebetween. A second ornamental component is physically associated with the first ornamental component, the loop, or the at least one cable segment. During ornamental mode, the interface and the at least one electronic component is partially or wholly hidden. During deployment mode, the at least one electronic component is placed in substantially immobilized contact to a surface of the individual that is not contacted by the loop.

17 Claims, 16 Drawing Sheets

WEARABLE ELECTRONIC DEVICE HAVING ORNAMENTAL AND DEPLOYMENT MODES

CROSS REFERENCE TO RELATED APPLICATIONS

This application claims priority to U.S. Provisional Application Ser. No. 62/166,105, entitled "WEARABLE ELECTRONIC DEVICE HAVING ORNAMENTAL AND DEPLOYMENT MODES," filed on May 25, 2015, by inventors Aniyia L. Williams and Thi Phuong-Nam Bagley, the disclosure of which is incorporated by reference in its entirety.

BACKGROUND OF THE INVENTION

The invention generally provides wearable electronic devices having ornamental and deployment modes. More specifically, the invention provides wearable electronic devices that, during ornamental mode, visually present as high-end jewelry of a luxurious nature such as those worn by socialites and style/fashion mavens.

There is a need for wearable electronic devices, e.g., audio earbud devices, which do not suffer from problems such as tangling wires. U.S. Patent Application Publication No. 20080161023 to Ko describes a decorative wireless earphone that is a single piece integrated with a necklace, a microphone, a main unit and an earpiece. The main unit has a shape of pendant, and the earplug is hidden behind the ornamental part. The lead wire is received in the necklace. The distance between the microphone and the earpiece is almost equal to the distance between the mouth and the ear of human.

U.S. Patent Application Publication No. 20110216931 to, describes electronic communication devices that are configured in the form of a personal accessory. The devices may include a communication module and at least one ear speaker operably connected to the communication module through at least one wire. The communication module enables wireless communication with another device, e.g., cellular telephones, digital data players, etc. The communication module may be concealed behind a first disguising component. At least one wire of the device may also be concealed within or run contiguously with another disguising component.

U.S. Patent Application Publication No. 20140338397 to Andreini, III et al. describes a decorative wireless earphone communication device. The decorative wireless earphone communication device may include a pendant housing the electronics for the device, a necklace which supports the pendant around the neck of the user, an earphone connected to the pendant, and a decorative faceplate removably attached to the front of the pendant. When the device is in use, the pendant and decorative faceplate hangs naturally around the neck of the user.

Nevertheless, additional opportunities exist to provide individuals interested in both beauty and functionality in audio devices. In some cases, such devices require no electronic power source during ornamental mode.

SUMMARY

In a first embodiment, a wearable electronic device is provided having ornamental and deployment modes. The device comprises a flexible loop, first and second ornamental components, at least one flexible cable segment, and an electronic interface. The flexible loop allows for at least partial conformal contact with a surface of an individual or the individual's clothing, or both. The first ornamental component is physically associated with the loop. The at least one flexible cable segment extends from the loop or the ornamental article. Each segment terminates in an electronic component. The electronic interface is wired to each electronic component for electronic communication therebetween. The second ornamental component is physically associated with the first ornamental component, the loop, or the at least one cable segment. During ornamental mode, the interface is partially or wholly hidden due to immobilization to the first or second ornamental component, and the at least one electronic component is partially or wholly hidden due to immobilization to another of the first or second ornamental components. During deployment mode, the at least one electronic component is placed in substantially immobilized contact to a surface of the individual that is not contacted by the loop.

The device may vary in construction. For example, the loop may be sized to encircle the individual's neck, head, arm, wrist, finger, torso, leg, ankle or toe. In some instances, the loop may comprise a chain. In addition, at least one ornamental component may be more rigid than the loop. Furthermore, at least one cable segment may comprise static shielding.

The device may a metallic surface finish, e.g., that is not prone to tarnish upon exposure to human skin. For example, the metallic surface finish may comprise gold, silver, or platinum.

The first and second electronic components may comprise first and second earphones, respectively, and the interface may comprise an audio jack. During ornamental mode, the earphones may be immobilized to the first ornamental component and the jack may be immobilized to the second ornamental component. The loop forming component may form a necklace strand and the first and second ornamental components may be located in a pendant-and-clasp relationship. Optionally, a third ornamental component may be provided for holding a cable segment extending from the jack. The first and third ornamental components may serve as modules that together form a unitary pendant physically associated with the loop. In such a case, the first and third ornamental components may have corresponding matching surfaces.

In any case, the device may include a jack cable segment extending from the jack, a first earphone cable segment extending from the first earphone, and a second earphone cable segment extending from the second earphone. The jack cable segment may exhibit a length that is within 1.5 to 2.5 times a combined length of the first and second earphone cable segments.

In some cases, the loop forms a necklace strand and the first and second ornamental components form a unitary pendant. The first ornamental component may comprise a cage. The second ornamental component may be located within the first ornamental component.

The loop may comprise a flexible portion attached to a curved portion, the curved portion including a microphone.

In some cases, the loop during ornamental mode the loop forms a necklace strand. At least one earphone or jack dangles from the first ornamental component. The second ornamental component may slidably hide the at least one dangling earphone or the dangling jack.

In another embodiment, a wearable audio device is provided having ornamental and deployment modes. The device includes a loop-forming component, a first flexible cable segment terminating in a first earphone, a second flexible cable segment terminating in a second earphone, a third flexible cable segment terminating in an audio jack that electronically communicates with the first and second earphone, an ornamental earphone component, and an ornamental jack component. During ornamental mode, the jack is partially or wholly hidden due to immobilization to the ornamental jack component, the first earphone, the second earphone, or both earphones are partially or wholly hidden due to immobilization to the ornamental earphone component, and the-loop forming component forms a necklace loop. During deployment mode, the a loop-forming component, the first, second, and third flexible cable segments, and the ornamental earphone and jack components remain physically associated with each other. Typically, the device excludes a physically associated electronic power source during ornamental mode.

BRIEF DESCRIPTION OF THE DRAWINGS

FIG. 1A shows the device in ornamental (necklace) mode. FIG. 1B shows the device in a transition mode. FIG. 1C shows the embodiment in deployment (ear bud) mode. FIG. 1D shows a model wearing the device in ornamental mode. FIG. 1E shows the same model wearing the device in deployment mode.

FIG. 2A shows the device in ornamental (necklace) mode. FIG. 2B shows the device in deployment (ear bud) mode. FIG. 2C shows a model wearing the device in ornamental mode. FIG. 2D shows the same model wearing the device in deployment mode.

FIG. 3A shows the device in ornamental (necklace) mode. FIG. 3B shows the device in deployment (ear bud) mode. FIG. 3C shows a model wearing the device in ornamental mode. FIG. 3D shows the same model wearing the device in deployment mode.

DETAILED DESCRIPTION OF THE INVENTION

Definitions and Overview

Figure 1A:
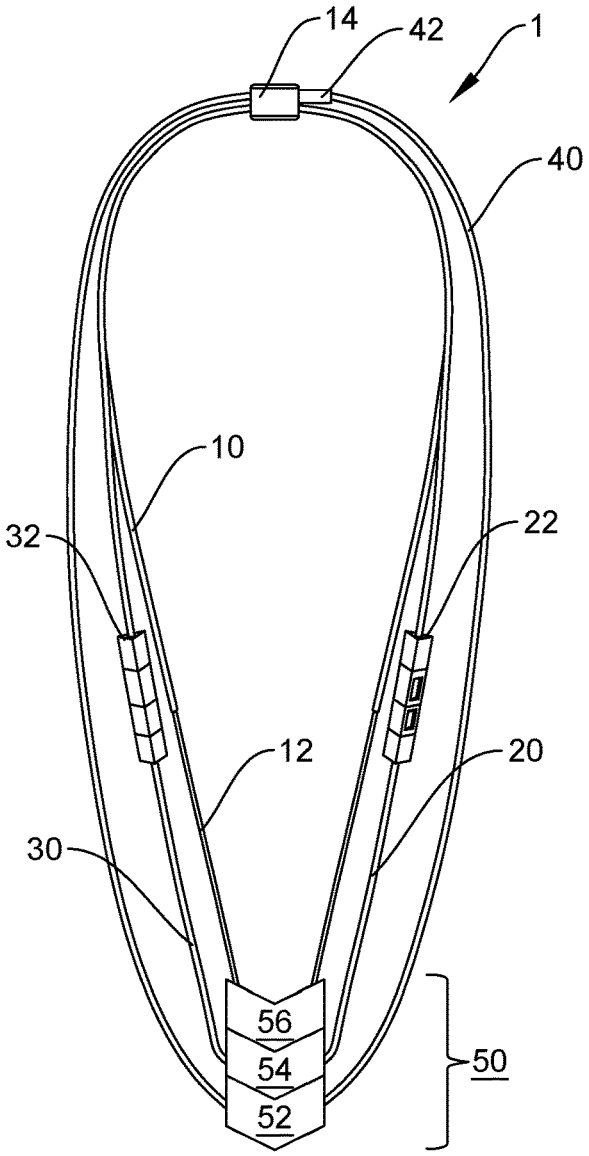
FIGS. 1A-1E, collectively referred to as FIG. 1, contain photographs that show an exemplary device the invention called Dipper.

Before describing the present invention in detail, it should be noted that embodiments of the invention may take the form of a useful process, machine, manufacture, or composition of matter, or any new and useful improvement thereof. It is also to be understood that the invention is not limited to specific makers of wearable devices or particular electronic communication protocols, as such may vary. It is further to be understood that the terminology used herein is for the purpose of describing particular embodiments only, and is not intended to be limiting.

In addition, as used in this specification and the appended claims, the singular article forms "a," "an," and "the" include both singular and plural referents unless the context clearly dictates otherwise. Thus, for example, reference to "a cable" includes a plurality of cables as well as a single cable, reference to "an electronic device" includes a single electronic device as well as a combination of electronic devices, and the like.

In addition, terminology indicative or suggestive of a particular spatial relationship between elements of the invention is to be construed in a relative sense rather an absolute sense unless the context of usage clearly dictates to the contrary. For example, an "upper" portion of an ornamental unit that also includes a lower portion does not necessarily indicate that the upper portion is always located above the lower portion.

In this specification and in the claims that follow, reference is made to a number of terms that shall be defined to have the following meanings, unless the context in which they are employed clearly indicates otherwise:

The terms "electronic," "electronically," and the like are used in their ordinary sense and relate to structures, e.g., semiconductor microstructures, that provide controlled conduction of electrons, holes and/or other charge carriers.

The term "jewelry" is used in its ordinary sense and refers to articles of personal adornment that serves at least an ornamental function, e.g., necklaces, head bands, earrings, rings, bracelets, cufflinks, belts, or anklets.

The term "mobile device" is used in its ordinary sense and refers to a portable, computing device, typically less than about 1 kilogram. Typically, mobile devices are wireless in nature and are powered by one or more secondary (rechargeable) batteries, though mobile devices may be powered by primary (nonrechargeable) batteries or wired powered sources. Mobile devices of the invention may be associated with a global positioning system (GPS). Exemplary mobile devices of the invention include smart phones, cell phones, MP3 players, tablet computers, etc.

"Optional" or "optionally" means that the subsequently described circumstance may or may not occur, so that the description includes instances where the circumstance occurs and instances where it does not.

The term "wireless" is used herein in its ordinary sense and refers to any of various devices that are operated with or actuated by electromagnetic waves rather than via hardwire or other physical connections. An electronic device may be both wired and wireless in nature.

In general, a wearable electronic device is provided. The device comprises a flexible loop, first and second ornamental components, at least one flexible cable segment, and an electronic interface. The flexible loops allows for at least partial conformal contact with a surface of an individual or the individual's clothing, or both. The first ornamental component is physically associated with the loop. The at least one flexible cable segment extends from the loop or the ornamental article. Each segment terminates in an electronic component. The electronic interface is wired to each electronic component for electronic communication therebetween. The second ornamental component is physically associated with the first ornamental component, the loop, or the at least one cable segment.

The device has ornamental and deployment modes. During ornamental mode, the interface is partially or wholly hidden due to immobilization to the first or second ornamental component, and the at least one electronic component is partially or wholly hidden due to immobilization to another of the first or second ornamental components. During deployment mode, the at least one electronic component is placed in substantially immobilized contact to a surface of the individual that is not contacted by the loop.

FIG. 1 show an exemplary audio device 1 of the invention called Dipper. The device 1 has a flexible loop comprised of portions 10 and chain segments 12. Located toward the back of the flexible loop is an elongate backpiece 14 that serves to gather all cables and features and inactive female jack receptacle and a debossed logo. Earbud cables 20 and 30 extend from backpiece 14, toward intervening items 22 and 32, respectively, and terminate in earbuds 24 and 34 respectively. Item 32 may be functional in nature and serves as a microphone and/or controller. In contrast, item 22 is ornamental in nature and similar appearance as item 32. Also extending from backpiece 14 is a jack cable 40 that terminates in a jack 42 for interfacing with a portable microelectronic device such as MP3 player or some other audio device. An ornamental pendent 50 may assembled by bringing together ornamental component, i.e., bottom chevron 52, middle chevron 54, and top chevron 56. Optionally, the chevrons may be magnetized and/or have snap-together surfaces for facile assembly.

Figure 1B:
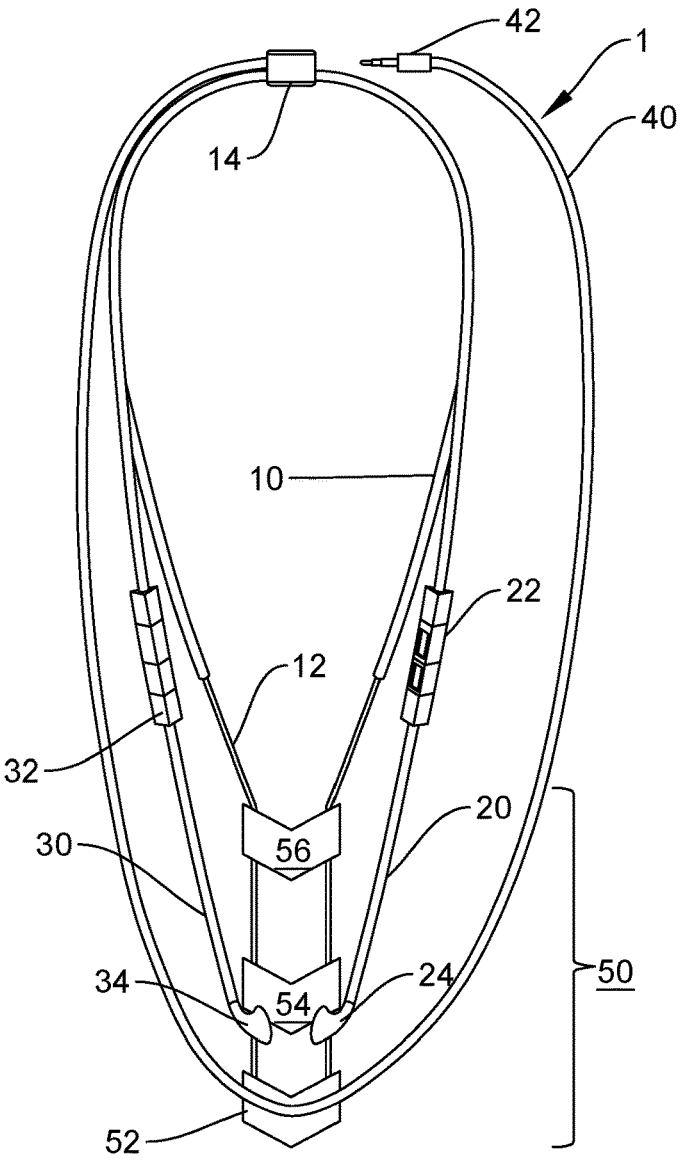
Figure 1C:
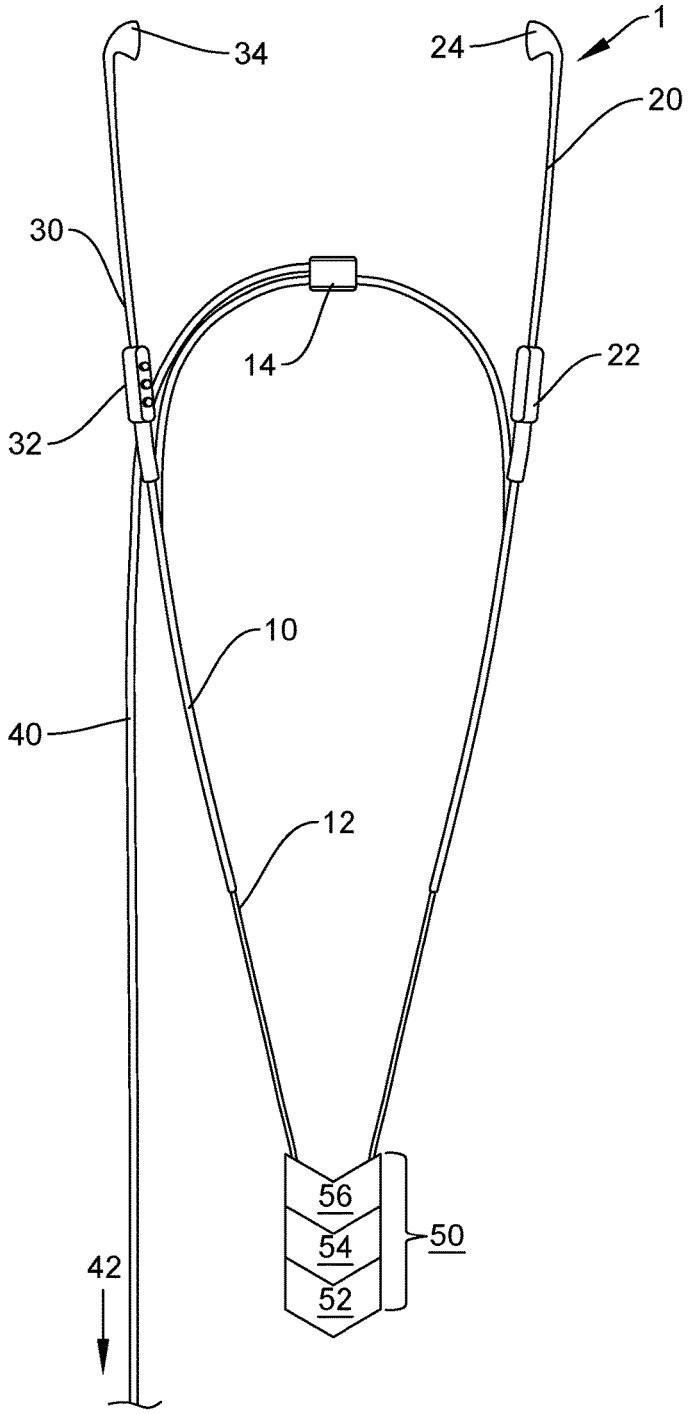
Figure 1D:
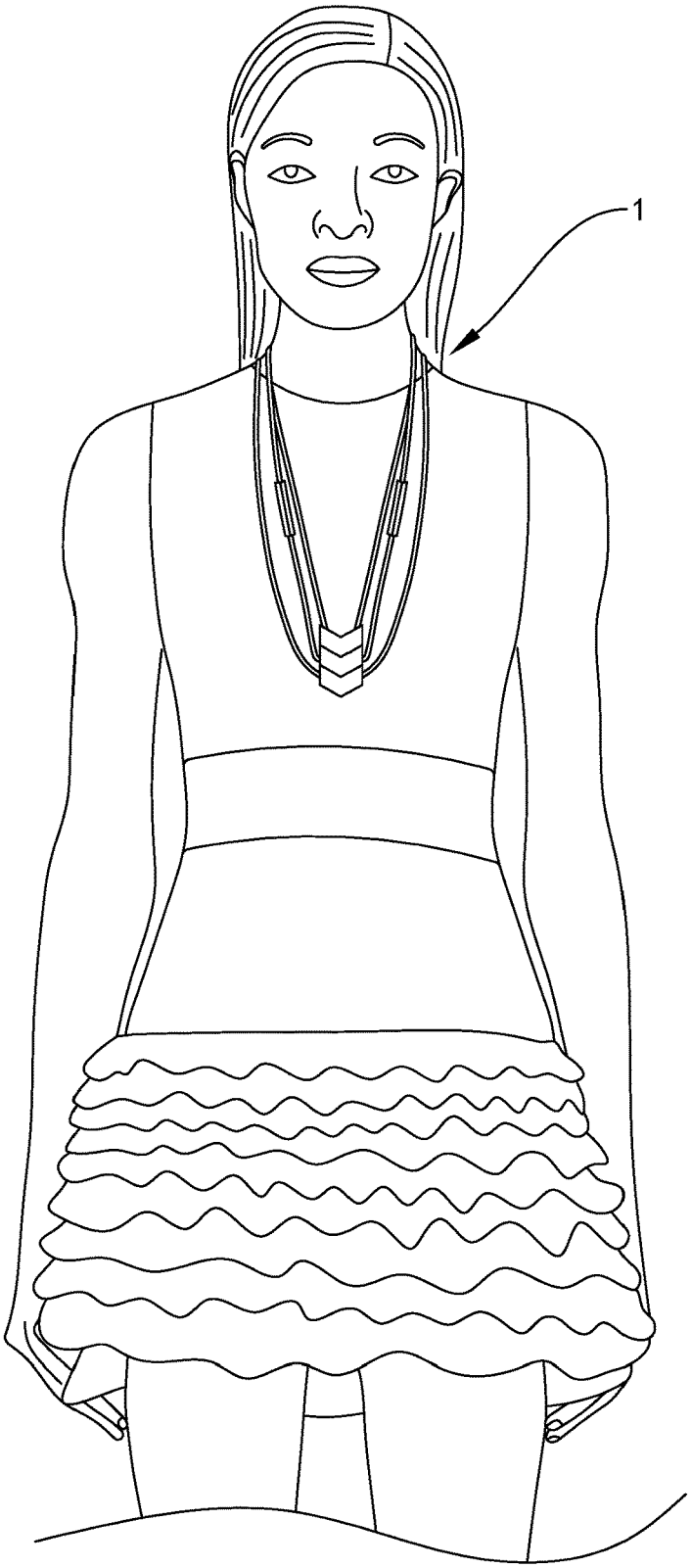

As shown in FIGS. 1A and 1D, the device 1 has the general appearance of an aesthetically pleasing necklace during ornamental mode. The jack cable 40 extends through the bottom chevron 52 of pending 50. As shown in FIG. 1A, and the jack 54 is plugged into a correspondingly shaped receptacle of the backpiece 14 such that the jack is partially or wholly hidden from view. Optionally, the jack cable 40 is slidably movable within the bottom chevron 52 through side grooves thereof so that the pendant 50 houses the middle of jack cable 40. In addition, earbuds 24 and 34 are immobilized via side grooves within the middle chevron 54 of the pendent 50. As a result, earbuds 24 and 34 are hidden from view. Earbud cables 20 and 30, jack cable 40, and necklace portions 10 and 12 appear to form strands of a necklace from which pendant 50 hangs.

FIG. 1B shows the device 1 in transition mode. Jack 42 has been removed from backpiece 14. Bottom chevron 52, middle chevron 54, and top chevron 56 are separated from each other. As a result, earbuds 24 and 34 may be removed from the middle chevron 54, and the jack cable 40 may be disassociated from the bottom chevron 52.

Notably, chain segments 12 remain extended through top chevron 56 and middle chevron 54 as well as attached to an interior portion of the bottom chevron 52. As a result, bottom chevron 52 may be considered a component of the device's flexible loop. The chain segments also help keep the chevrons from being misplaced.

Figure 1E:
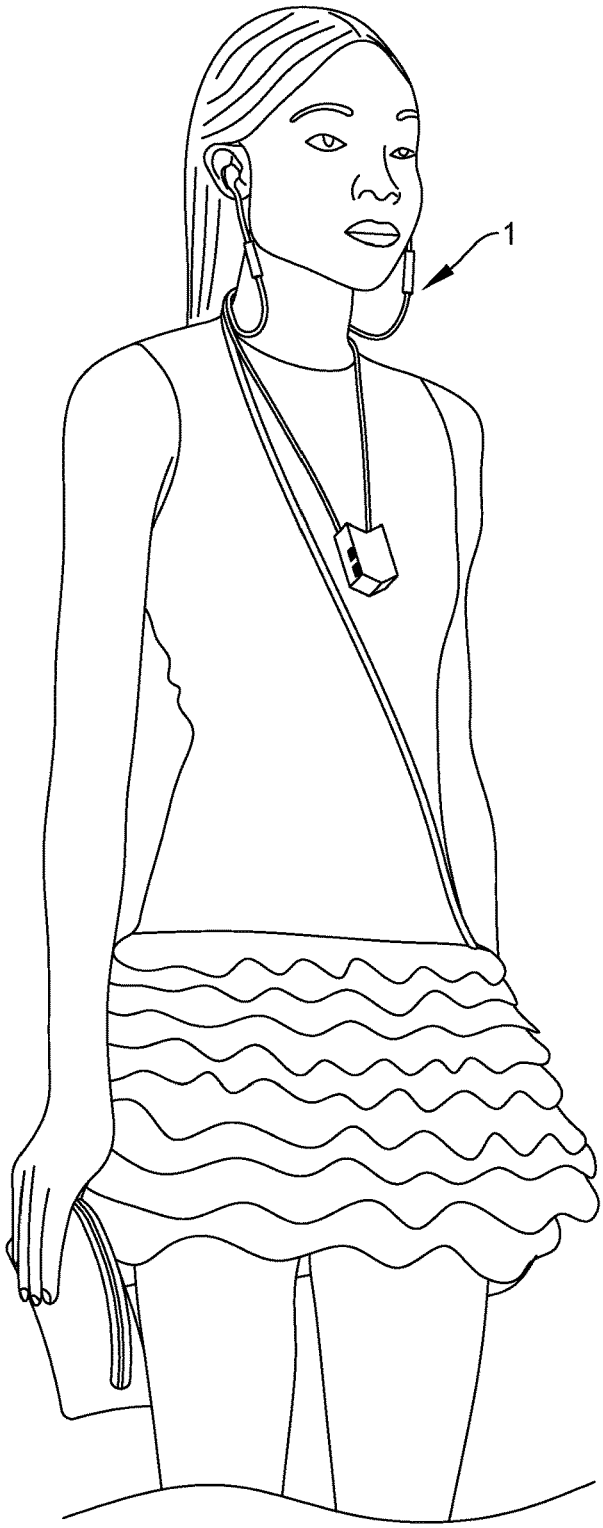

FIGS. 1C and 1E show the device 1 in deployment mode. Earbuds 24 and 34 are freed from immobilization from pendant 50 for placement within the ears of an individual. Similarly, jack 42 may be interfaced with an audio device (not shown). As shown in FIG. 1E, items 22 and 32 of the device in deployment mode look like dangling ear rings.

FIG. 2 shows another exemplary device of the invention called Caged Beauty. The device 1 a flexible loop comprised of curved but rigid backpiece 10 and chain segments 12 extending from ends thereof. The backpiece may be wrapped with leather for comfort and style. Also extending from the ends of the backpiece 10 are: earbud cable 20, which terminates in silicone covered earbud 24; silicone covered earbud cable 30, which terminates in a silicone covered earbud 34; and silicone covered jack cable 40, which terminates in jack 42. Controller and/or microphone 32 is located at an end of backpiece 10.

Figure 2A:
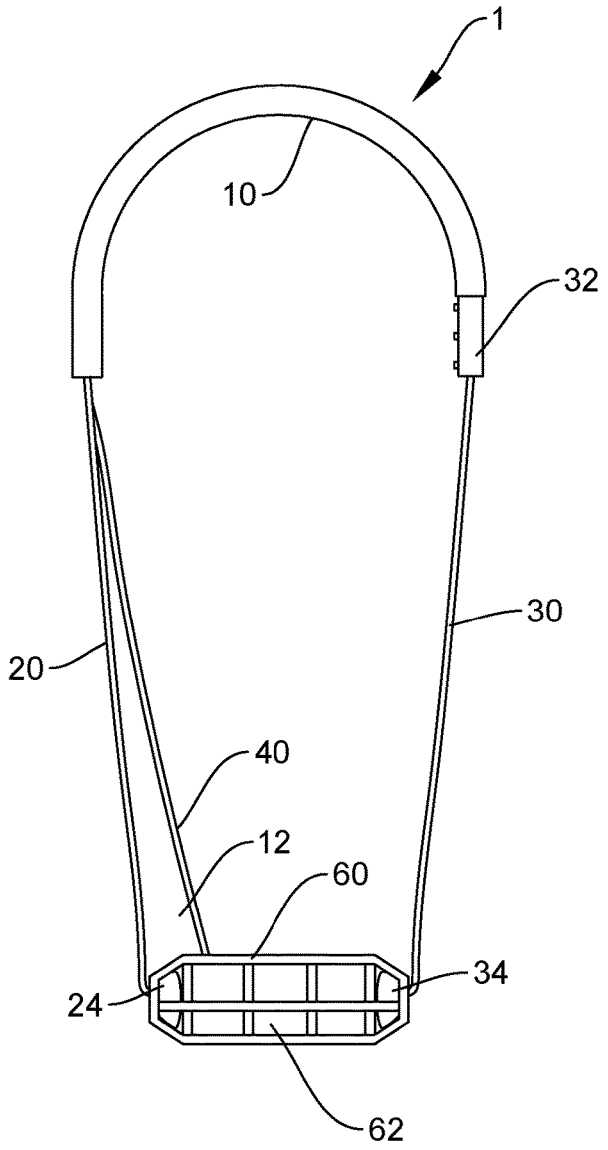
FIGS. 2A-2D, collectively referred to as FIG. 2, contain photographs that show another exemplary device of the invention called Caged Beauty.

Chain segments are attached to ornamental cage 60. Located within the cage 60 is an silicone ornamental case 62 having a slit that provides access to the case's interior. At the ends of the cage are openings through which flexible earbuds can be inserted. As shown in FIGS. 2A and 2C, the device 1 has the general appearance of an aesthetically pleasing necklace during ornamental mode. The bulk of jack cable 40 and jack 40 are stored within case 62. Accordingly, the jack is wholly hidden from view. In addition, earbuds 24 and 34 are immobilized via opening at the ends of case 60. As a result, earbuds 24 and 34 are partially hidden from view. Earbud cables 20 and 30, jack cable 40, and backpiece 10 chain segments 12 appear to form strands of a necklace from which cage 60 hangs.

Figure 2B:
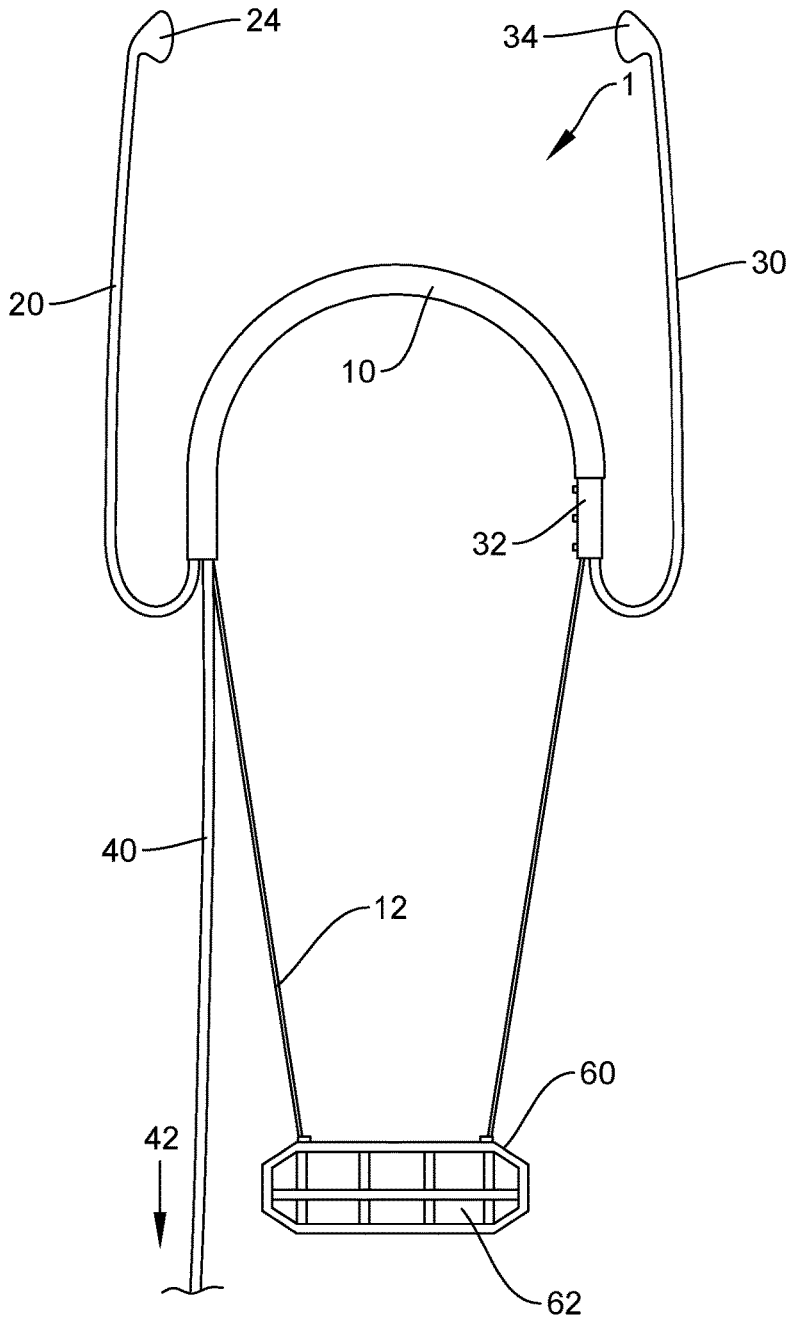
Figure 2C:
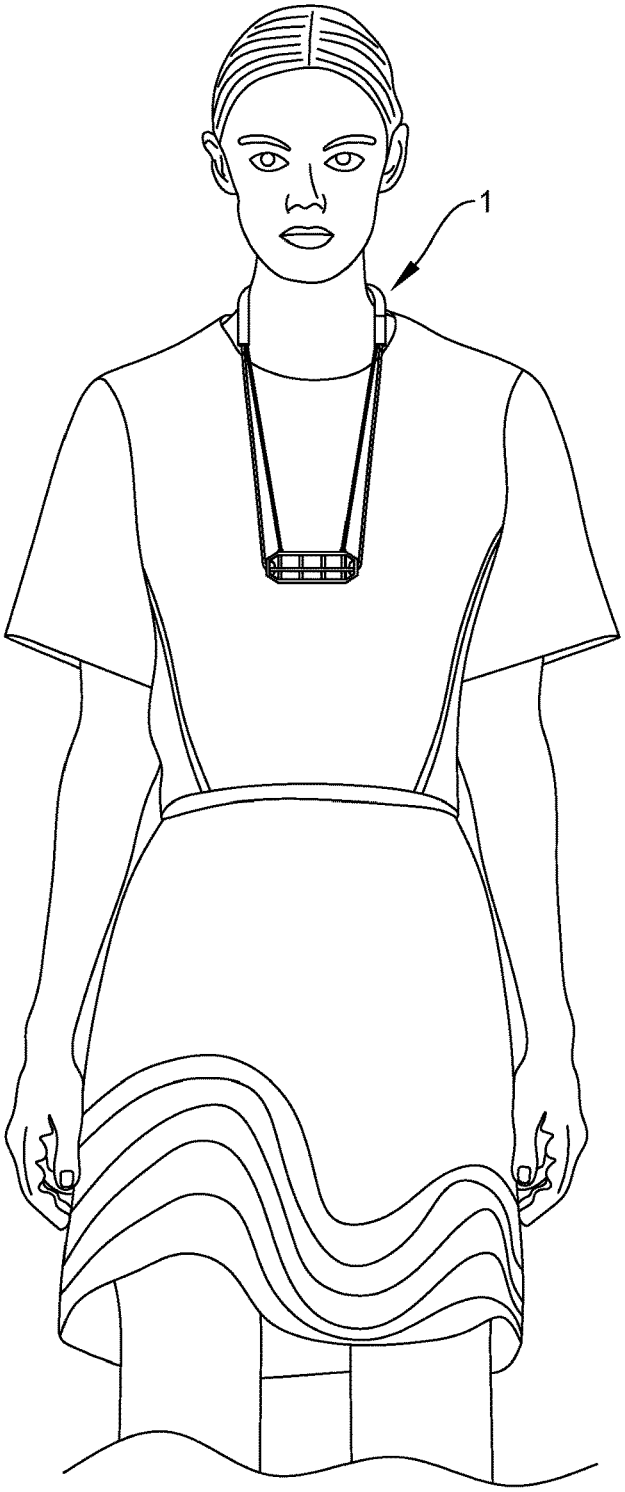
Figure 2D:
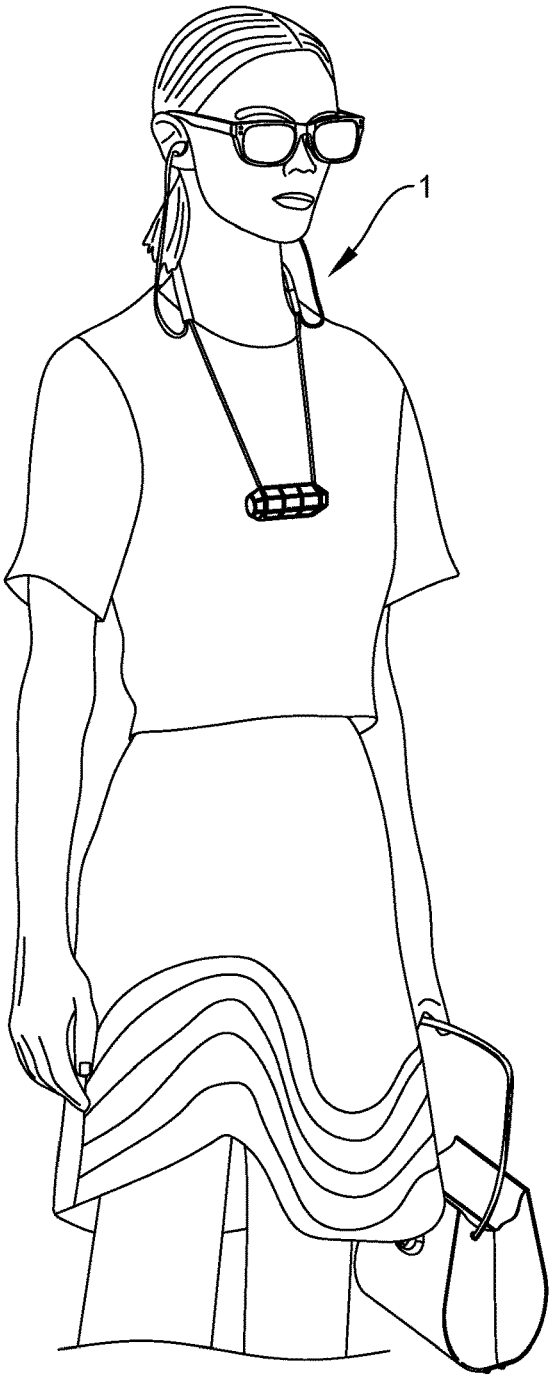

FIGS. 2B and 2D show the device 1 in deployment mode. Earbuds 24 and 34 are freed from immobilization from cage 60 for placement within the ears of an individual. Similarly, jack 42 may be interfaced with an audio device (not shown). FIG. 3 shows another exemplary device of the invention called Chic Lapel. The device 1 has a flexible loop 10 having an integrated microphone and/or controller 32. The loop 10 is attached ornamental component 70 having a two-piece interlocking lapel signature detail. In some instances, two lapel halves are constructed to close the necklace. Earbud cables 20 and 30 extend from different branch of ornamental component 70, and terminate in earbuds 24 and 34 respectively. Jack cable 40 that terminates in a jack 42 for interfacing with a portable microelectronic device such as MP3 player or some other audio device.

Figure 3A:
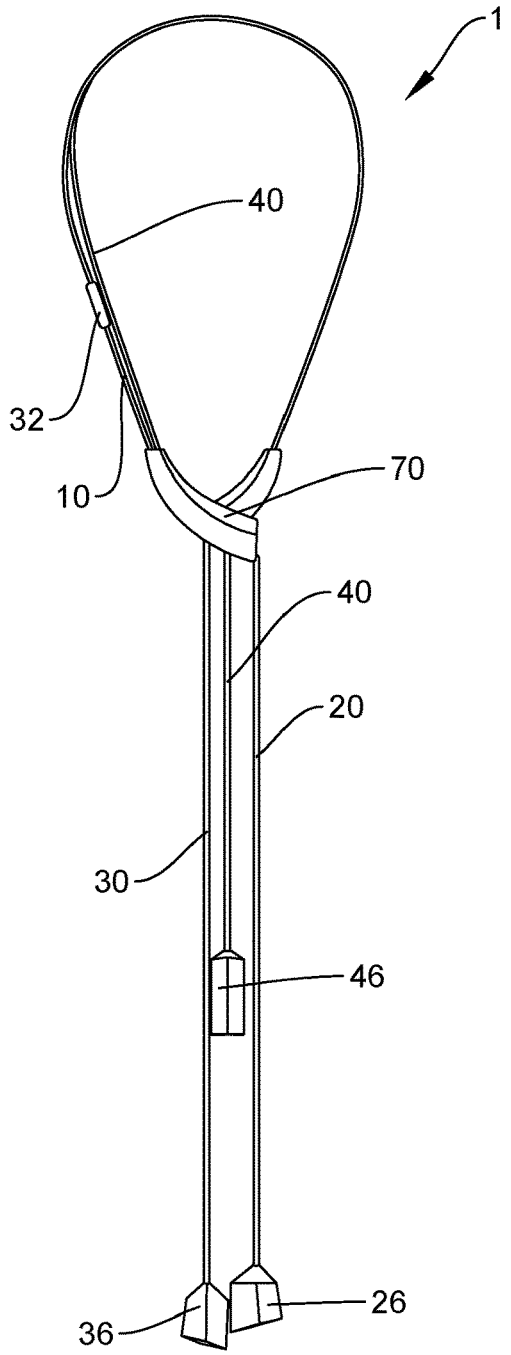
FIGS. 3A-3D, collectively referred to as FIG. 3, contain photographs that show another exemplary device of the invention called Chic Lapel.
Figure 3B:
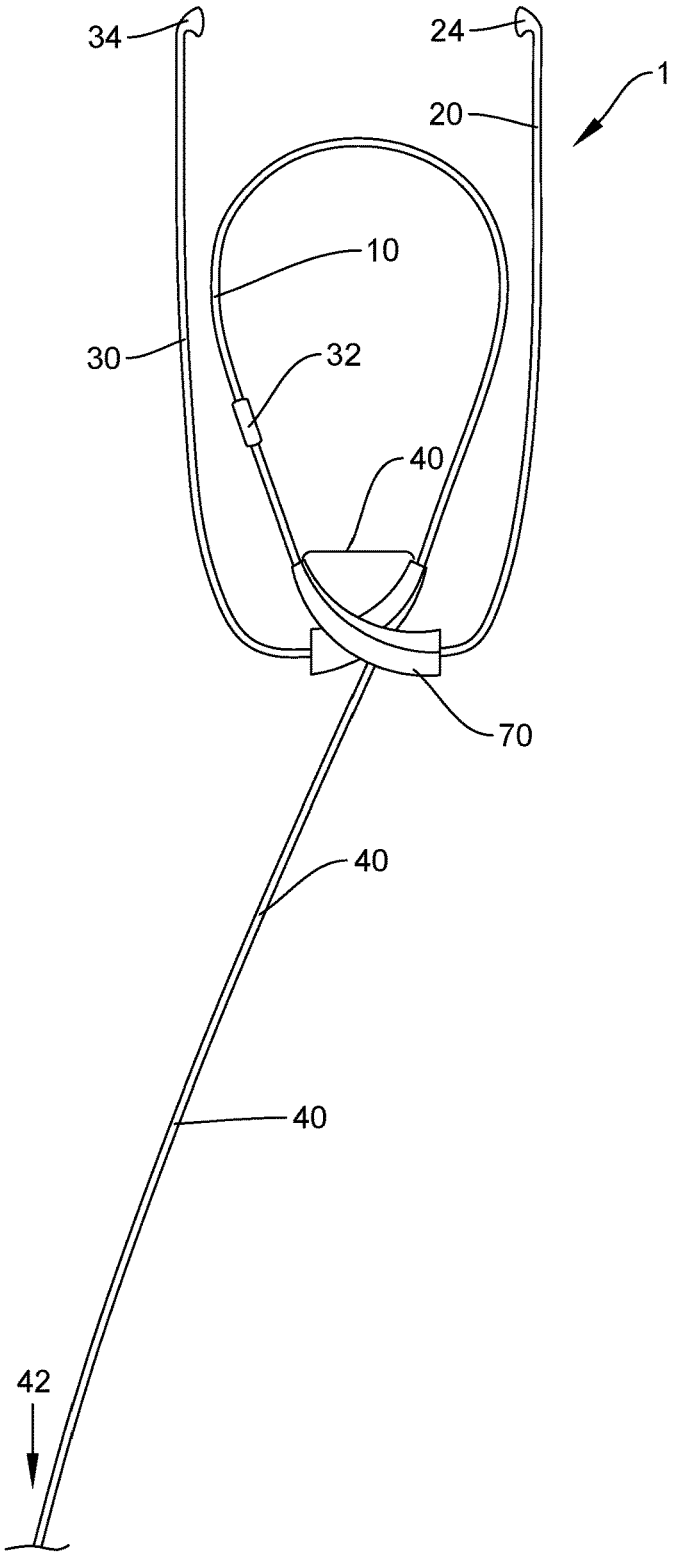
Figure 3C:
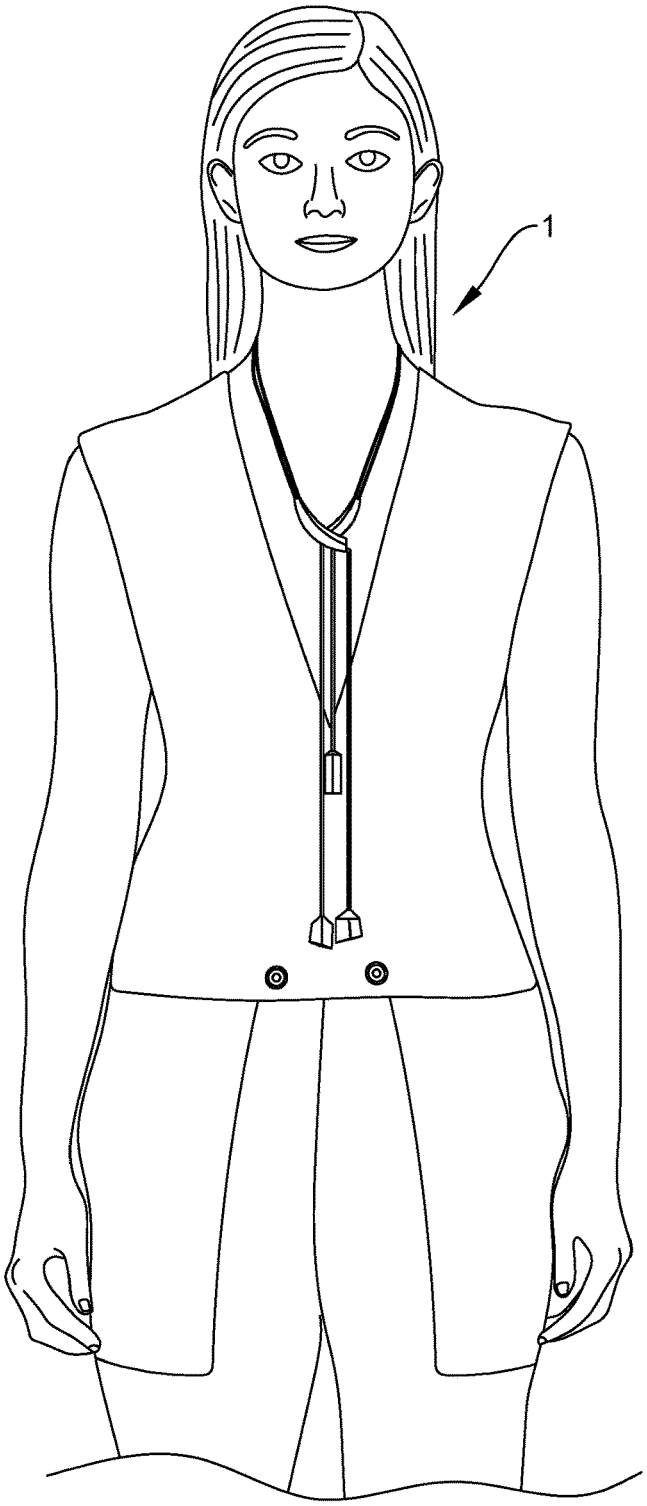

As shown in FIGS. 3A and 3C, the device 1 has the general appearance of an aesthetically pleasing necklace during ornamental mode. Earbuds cables 20 and 30 are downwardly free-hanging from different branches of component 70, and earbuds 24 and 34 are hidden from view by ornamental components 26 and 36, respectively. Ornamental components 26 and 36 are each in the shape of partially hammered bells. The jack cable 40 loops coextensively with loop 10, extends through ornamental component 70, and free hangs downwardly as well. Three-button controller 32 is located on loop 10. Ornamental component 46 in the shape of a partially hammered bell covers jack 26, thereby hiding it from view.

Figure 3D:
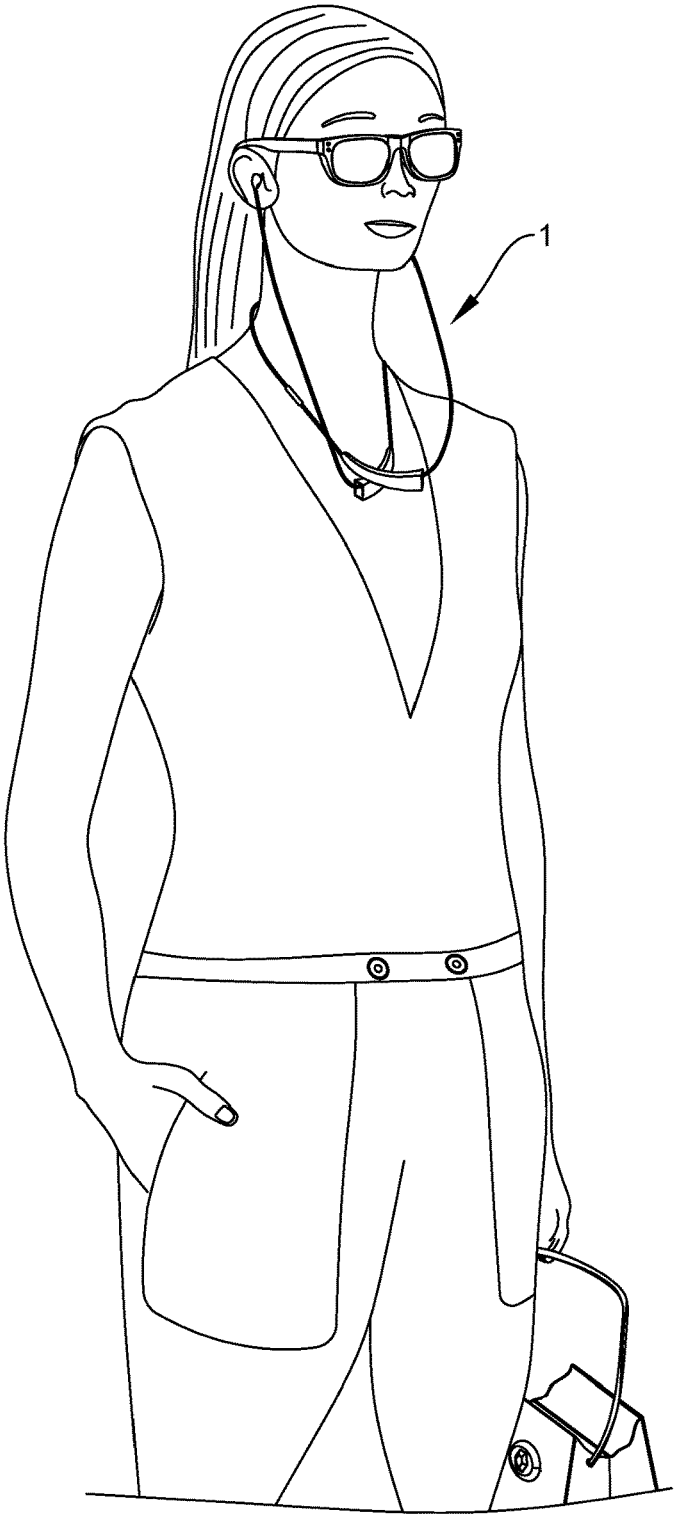

FIGS. 3B and 3D show the device 1 in deployment mode. Ornamental components 26, 36, and 46 may be pulled up and magnetically connected to the ornamental component. As a result, earbuds 24 and 34 may be placed within the ears of an individual. Jack cable 40 may be interfaced with an audio device (not shown).

Figure 4:
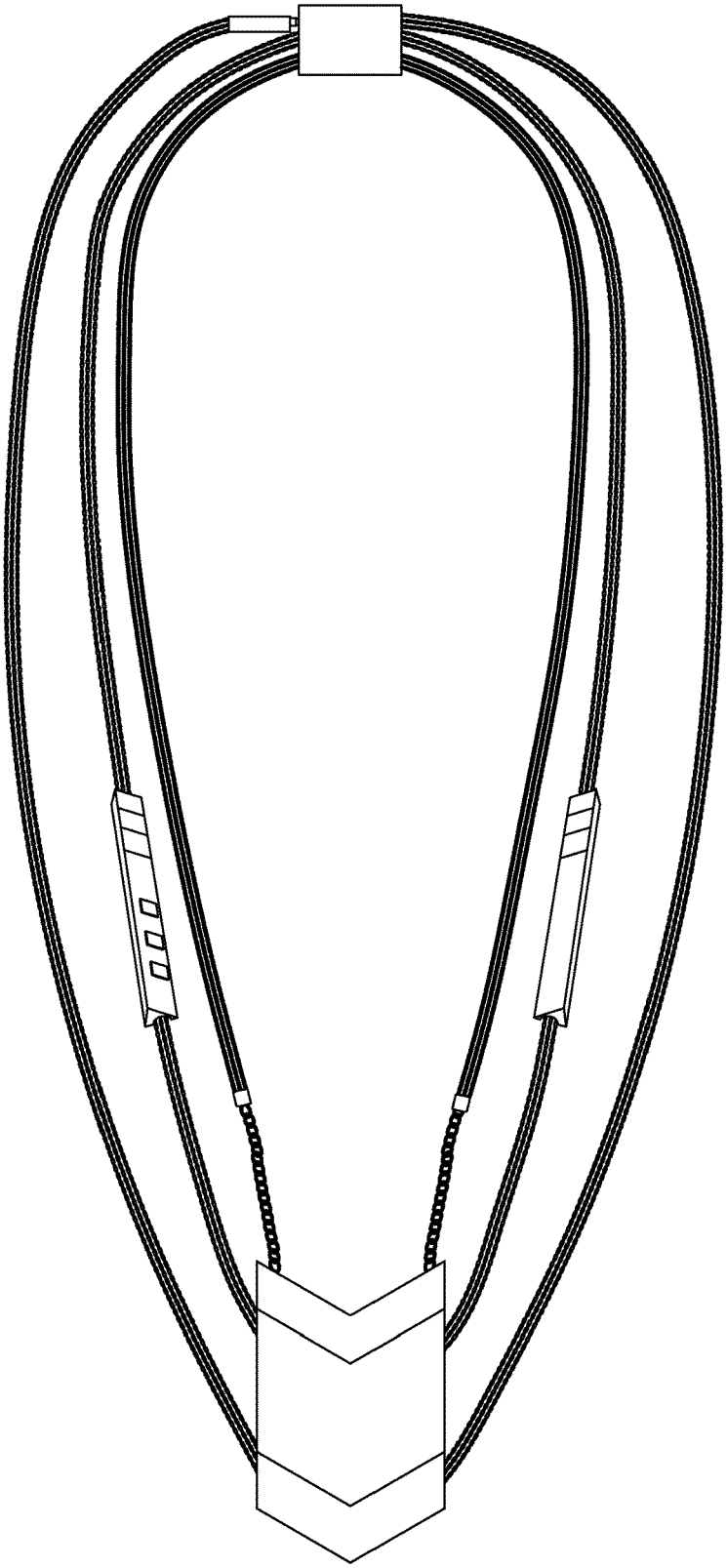
FIG. 4 is a photograph showing a variant of the Dipper device shown in FIG. 1.
Figure 7:
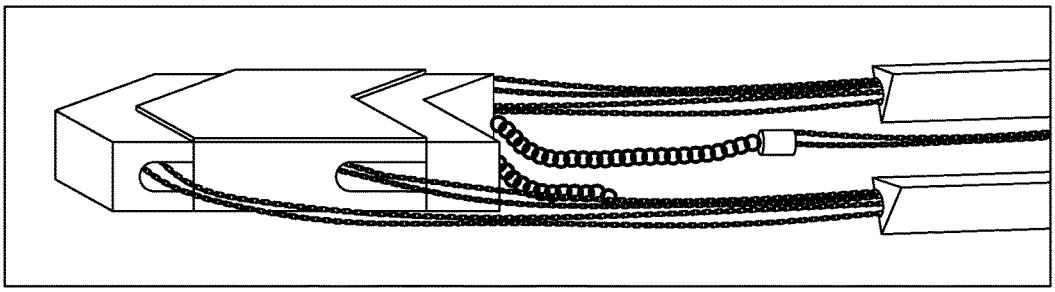
FIG. 7 is a side-view photograph of a portion of the Dipper device shown in FIG. 4.

Variations of the above described device are possible. FIG. 4 is a photograph showing a variant of the Dipper device shown in FIG. 1. The device shown in FIG. 4 exhibits a number of differences from the device shown in FIG. 1. For example, the device of FIG. 4 has a pendent whose middle chevron is proportionally larger than the top and bottom chevrons. A side view of the pendent of FIG. 4 is shown in FIG. 7.

Figure 5:
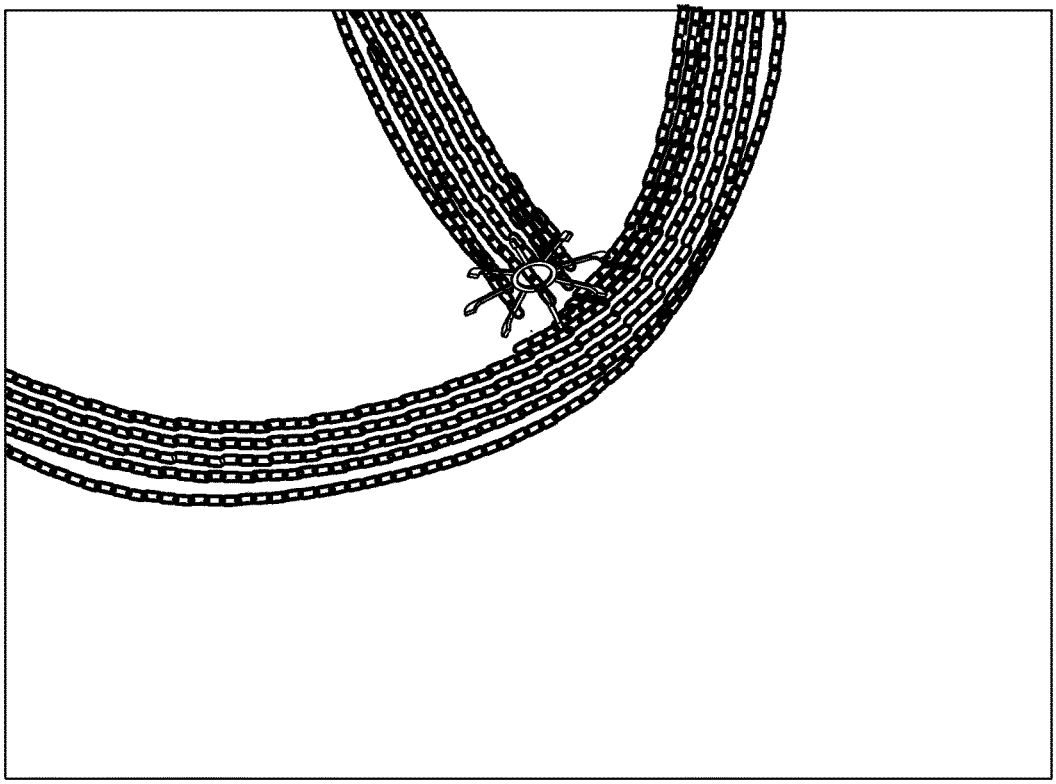
FIG. 5 is a close-up photograph of a hollow metal cabling sheath of the Dipper device shown in FIG. 4
Figure 6:
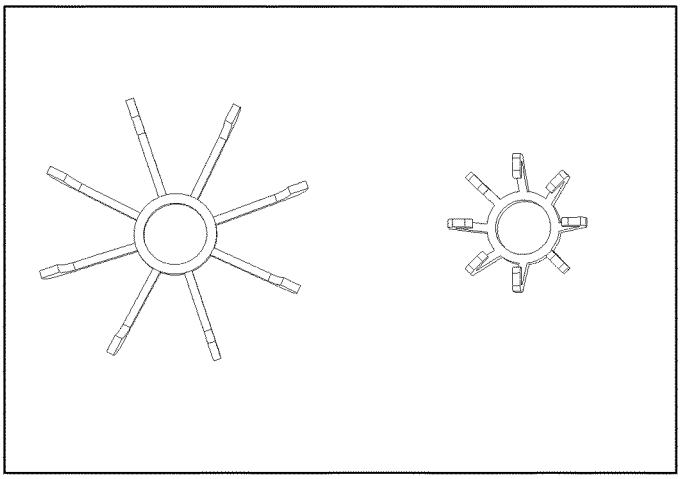
FIG. 6 is a photograph of a cabling component that may be interlinked to form the hollow metal cabling sheath shown in FIG. 5.

In addition, the cables of the device shown in FIG. 4 are covered by a hollow metal cabling sheath. FIG. 5 is a close-up photograph of a hollow metal cabling sheath of the Dipper device shown in FIG. 4. The hollow sheath may be formed by interlinking cabling components shown in FIG. 6 to form the hollow metal cabling sheath shown in FIG. 5. The sheaths help shield the cables from electromagnetic interference that may compromise the performance of the device. In some cases, solid metallic tubular links may be used in place of sheaths to serve substantially the same purpose.

Variations on the invention will be apparent to persons of ordinary skill in the art. For example, the invention may exhibit any of a number of form factors and feature. Such form factors and features may enhance the functionality and/or aesthetic appeal of the invention. For example, the jack is typically gold plated to ensure high-end audio performance. In addition, the jack may be of a standard size, e.g., 3.5 mm for compatibility with audio devices.

Exemplary color schemes for the Dipper device include: Concrete, which features matte gold chains, gray woven cables, and concrete ornamental components; Porcelain, which features matte gold chains, white woven cables, and while enameled porcelain ornamental components; and Wood, which features shine gold chains, black woven cables, and rich dark wooed ornamental components. Exemplary color schemes for the Caged Beauty device include: Blackout, which features, black chrome, black silicone, black leather, and purple silicone accent; Mod, which features, silver, powder coated white steel, black silicon, and white leather; and Luxe, which features gold, black silicone, and black leather. Exemplary color schemes for the Chic Lapel device include: Black Chrome, which features black metal welded cables, and hammered black chrome ornamental components; Copper, which features polished and/or hammered copper ornamental components, copper welded chains, and black leather cables; and Gold, which features polished and/or hammered gold ornamental components, gold welded chains, and silver.

The invention may also include or exclude certain elements as desired. For example, certain embodiments of the invention may include or exclude integrated volume controls or speakers. In some cases, the volume control or speaker may face the device's wearer.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, while the invention has generally been described in terms of wired audio devices that may include earphones that may physically interface with an electronic device such as a mobile phone, the invention does not necessarily exclude wireless technology.

What is claimed is:

1. A wearable electronic device having ornamental and deployment modes, comprising, a flexible loop that allows for at least partial conformal contact with a surface of an individual or the individual's clothing, or both;

a first ornamental component physically associated with the loop;

at least one flexible cable segment, extending from the loop or the ornamental article, each segment terminating in an electronic component;

an electronic interface wired to each electronic component for electronic communication therebetween;

a second ornamental component, physically associated with the first ornamental component, the loop, or the at least one cable segment; and a third ornamental component, wherein the first and third ornamental components serve as modules that together form a unitary pendant physically associated with the loop, and further wherein during ornamental mode, the interface is partially or wholly hidden due to immobilization to the first or second ornamental component, and the at least one electronic component is partially or wholly hidden due to immobilization to another of the first or second ornamental components, and during deployment mode, the at least one electronic component is placed in substantially immobilized contact to a surface of the individual that is not contacted by the loop.

2. The device of claim 1, wherein the loop is sized to encircle the individual's neck, head, arm, wrist, finger, torso, leg, ankle or toe.

3. The device of claim 1, wherein the loop comprises a chain.

4. The device of claim 1, wherein at least one ornamental component is more rigid than the loop.

5. The device of claim 1, wherein at least one cable segment comprises static shielding.

6. The device of claim 1, wherein the first and second electronic components comprise first and second earphones, respectively.

7. The device of claim 6, wherein the interface comprises an audio jack.

8. The device of claim 7, wherein, during ornamental mode, the earphones are immobilized to the first ornamental component and the jack is immobilized to the second ornamental component.

9. The device of claim 8, wherein the loop forming component forms a necklace strand and the first and second ornamental components are located in a pendant-and-clasp relationship.

10. The device of claim 9, wherein the third ornamental component is constructed for holding a cable segment extending from the jack.

11. The device of claim 10, wherein the first and third ornamental components have corresponding matching surfaces.

12. The device of claim 9, comprising a jack cable segment extending from the jack, a first earphone cable segment extending from the first earphone, and a second earphone cable segment extending from the second earphone, wherein the jack cable segment has a length that is within 1.5 to 2.5 times a combined length of the first and second earphone cable segments.

13. The device of claim 8, wherein the loop forms a necklace strand and the first and second ornamental components form a unitary pendant.

14. The device of claim 13, wherein the first ornamental component comprises a cage.

15. The device of claim 13, wherein the second ornamental component is located within the first ornamental component.

16. The device of claim 13, wherein the loop comprises a flexible portion attached to a curved portion, the curved portion including a microphone.

17. A wearable audio device having ornamental and deployment modes, comprising, a loop-forming component;

a first flexible cable segment terminating in a first earphone;

a second flexible cable segment terminating in a second earphone;

a third flexible cable segment terminating in an audio jack that electronically communicates with the first and second earphone;

an ornamental earphone component; and an ornamental jack component;

wherein the third flexible cable segment has a length that is within 1.5 to 2.5 times a combined length of the first and second flexible cable segments, further wherein during ornamental mode, the jack is partially or wholly hidden due to immobilization to the ornamental jack component, the first earphone, the second earphone, or both earphones are partially or wholly hidden due to immobilization to the ornamental earphone component, and the loop forming component forms a necklace loop, and during deployment mode, the loop-forming component, the first, second, and third flexible cable segments, and the ornamental earphone and jack components remain physically associated with each other.

* * * * *